US005461406A

United States Patent [19]

Lorenze, Jr. et al.

[11] Patent Number: 5,461,406

[45] Date of Patent: Oct. 24, 1995

[54] METHOD AND APPARATUS FOR ELIMINATION OF MISDIRECTED SATELLITE DROPS IN THERMAL INK JET PRINTHEAD

[75] Inventors: Robert V. Lorenze, Jr., Webster; Daniel E. Kuhman, Fairport, both of N.Y.

[73] Assignee: Xerox Corporation, Stamford, Conn.

[21] Appl. No.: 176,379

[22] Filed: Jan. 3, 1994

[51] Int. Cl.[6] ..... B41J 2/135

[52] U.S. Cl. ..... 347/65; 29/890.1; 216/27; 347/45; 347/47

[58] Field of Search ..... 347/45, 47, 63, 347/64, 65, 20; 216/27; 29/890.1

[56] References Cited

U.S. PATENT DOCUMENTS

| | | | |
|---|---|---|---|
| 4,601,777 | 7/1986 | Hawkins et al. | 347/63 |
| 4,638,337 | 1/1987 | Torpey | 347/65 |
| 4,774,530 | 9/1988 | Hawkins | 347/42 X |
| 4,851,371 | 7/1989 | Fisher et al. | 347/63 |
| 4,878,992 | 11/1989 | Campanelli | 347/56 X |
| 4,990,939 | 2/1991 | Sekiya | 347/62 |
| 5,057,853 | 10/1991 | Fisher | 347/47 |
| 5,068,006 | 11/1991 | Fisher | 347/63 X |
| 5,212,496 | 5/1993 | Badesha | 347/45 |

FOREIGN PATENT DOCUMENTS

| | | | |
|---|---|---|---|
| 360262660 | 12/1985 | Japan | B41J 3/04 |

*Primary Examiner*—Joseph W. Hartary
*Attorney, Agent, or Firm*—Oliff & Berridge

[57] ABSTRACT

An apparatus and method for ejecting ink droplets from a plurality of nozzles located in the front face of a printhead controls front face geometries to ensure consistent image quality. A front face dicing angle and a thick film insulative layer etchback are controlled to maintain a Spot Aspect Ratio of each of the droplets ejected from the printhead within a predetermined acceptable range. The Spot Aspect Ratio may be maintained by control of an effective meniscus tilt angle.

25 Claims, 8 Drawing Sheets

METHOD AND APPARATUS FOR ELIMINATION OF MISDIRECTED SATELLITE DROPS IN THERMAL INK JET PRINTHEAD

BACKGROUND OF THE INVENTION

1. Field of the Invention

This invention relates to ink jet printing, and more particularly to a thermal ink jet printhead apparatus and method for elimination of misdirected satellite drops by control of the effective meniscus tilt angle of ink at the nozzles of an ink jet printhead.

2. Description of the Prior Art

In existing thermal ink jet printing, the printhead comprises one or more ink filled channels, such as disclosed in U.S. Pat. No. 4,463,359 to Ayata et al., communicating with a relatively small ink supply chamber at one end and having an opening at the opposite end, referred to as a nozzle. A thermal energy generator, usually a resistor, is located in the channels near the nozzles a predetermined distance therefrom. The resistors are individually addressed with a current pulse to momentarily vaporize the ink and form a bubble which expels an ink droplet. As the bubble grows, the ink bulges from the nozzle and is contained by the surface tension of the ink as a meniscus. As the bubble begins to collapse, the ink still in the channel between the nozzle and bubble starts to move towards the collapsing bubble causing a volumetric contraction of the ink at the nozzle and resulting in the separation of the bulging ink as a droplet. The acceleration of the ink out of the nozzle while the bubble is growing provides the momentum and velocity of the droplet in a substantially straight line direction towards a recording medium, such as paper.

The printhead of U.S. Pat. No. 4,463,359 has one or more inkfilled channels which are replenished by capillary action. A meniscus is formed at each nozzle to prevent ink from weeping therefrom. A resistor or heater is located in each channel upstream from the nozzles. Current pulses representative of data signals are applied to the resistors to momentarily vaporize the ink in contact therewith and form a bubble for each current pulse. Ink droplets are expelled from each nozzle by the growth and collapse of the bubbles. Current pulses are shaped to prevent the meniscus from breaking up and receding too far into the channels, after each droplet is expelled. Various embodiments of linear arrays of thermal ink jet devices are shown such as those having staggered linear arrays attached to the top and bottom of a heat sinking substrate and those having different colored inks for multiple colored printing.

U.S. Pat. No. 4,601,777 to Hawkins et al. discloses several fabricating processes for ink jet printheads, each printhead being composed of two parts aligned and bonded together. One part is substantially a flat heater plate substrate which contains on the surface thereof a linear array of heating elements and addressing electrodes, and the second part is a channel plate substrate having at least one recess anisotropically etched therein to serve as an ink supply manifold when the two parts are bonded together. A linear array of parallel grooves are formed in the second part, so that one end of the grooves communicate with the manifold recess and the other ends are open for use as ink droplet expelling nozzles. Many printheads can be simultaneously made by producing a plurality of sets of heating element arrays with their addressing electrodes on, for example, a silicon wafer and by placing alignment marks thereon at predetermined locations. A corresponding plurality of sets of channels and associated manifolds are produced in a second silicon wafer and, in one embodiment, alignment openings are etched thereon at predetermined locations. The two wafers are aligned via the alignment openings and alignment marks and then bonded together and diced into many separate printheads. A number of printheads can be fixedly mounted on a pagewidth configuration which confronts a moving recording medium for pagewidth printing or individual printheads may be adapted for carriage type ink jet printing. In this patent, the parallel grooves which are to function as the ink channels when assembled are individually milled as disclosed in FIG. 6B or anisotropically etched concurrently with the manifold recess. In this latter fabrication approach, the grooves must be opened to the manifold; either they must be diced open as shown in FIGS. 7 and 8, or an additional isotropic etching step must be included. This invention eliminates the fabrication step of opening the elongated grooves to the manifold when they are produced by etching.

U.S. Pat. No. 4,639,748 to Drake et al. discloses an ink jet printhead similar to that described in the patent to Hawkins et al., but additionally containing an internal integrated filtering system and fabricating process therefor. Each printhead is composed of two parts aligned and bonded together. One part is a substantially flat substrate which contains on the surface thereof a linear array of heating elements and addressing electrodes. The other part is a flat substrate having a set of concurrently etched recesses in one surface. The set of recesses include a parallel array of elongated recesses for use as capillary filled ink channels having ink droplet emitting nozzles at one end and having interconnection with a common ink supplying manifold recess at the other ends. The manifold recess contains an internal closed wall defining a chamber with an ink fill hole. Small passageways are formed in the internal chamber walls to permit passage of ink therefrom into the manifold. Each of the passageways have smaller cross-sectional flow areas than the nozzles to filter the ink, while the total cross sectional flow area of the passageways is larger than the total cross sectional flow area of the nozzles. As in Hawkins et al., many printheads can be simultaneously made by producing a plurality of sets of heating element arrays with their addressing electrodes on a silicon wafer and by placing alignment marks thereon at predetermined locations. A corresponding plurality of sets of channels and associated manifolds with internal filters are produced on a second silicon wafer and in one embodiment alignment openings are etched thereon at predetermined locations. The two wafers are aligned via the alignment openings and alignment marks, then bonded together and diced into many separate printheads.

Misdirected satellite drops can be produced by conventional thermal ink jet printheads and can result in observable print quality defects. Such misdirected satellite drops are typically generated when the plane of the ink meniscus in the channel deviates by more than a certain amount from perpendicular to the plane of the channels.

SUMMARY OF THE INVENTION

This invention therefore provides a method and apparatus for elimination of misdirected satellite drops in thermal ink jet printheads.

This invention also provides a method and apparatus for reduction of an effective meniscus tilt angle so as to eliminate misdirected satellite drops in thermal ink jet printheads.

This invention further provides allowable ranges for a front face dicing angle and for an etchback of a thick film organic layer interposed between the channel plate and the heater plate of an ink jet printhead.

The present invention, provides these and other features in a thermal ink jet printhead having a plurality of heating elements patterned on a heater plate, a channel plate having a plurality of grooves etched therein for use as ink channels, a thick film organic layer disposed on the heater plate that exposes a heating element in each ink channel. A hydrophobic front face coating process is applied to the front face of the printhead to improve directionality of ejected drops. A plasma cleaning step done prior to deposition for the purpose of improving front face coating adhesion can cause an etchback in the thick film organic layer. A front face dicing angle and the etchback are controlled to eliminate visible effects of misdirected satellite drops.

A more complete understanding of the present invention can be obtained by considering the following detailed description in conjunction with the accompanying drawings, wherein like index numerals indicate like parts.

DETAILED DESCRIPTION OF THE PREFERRED EMBODIMENTS

Figure 1:
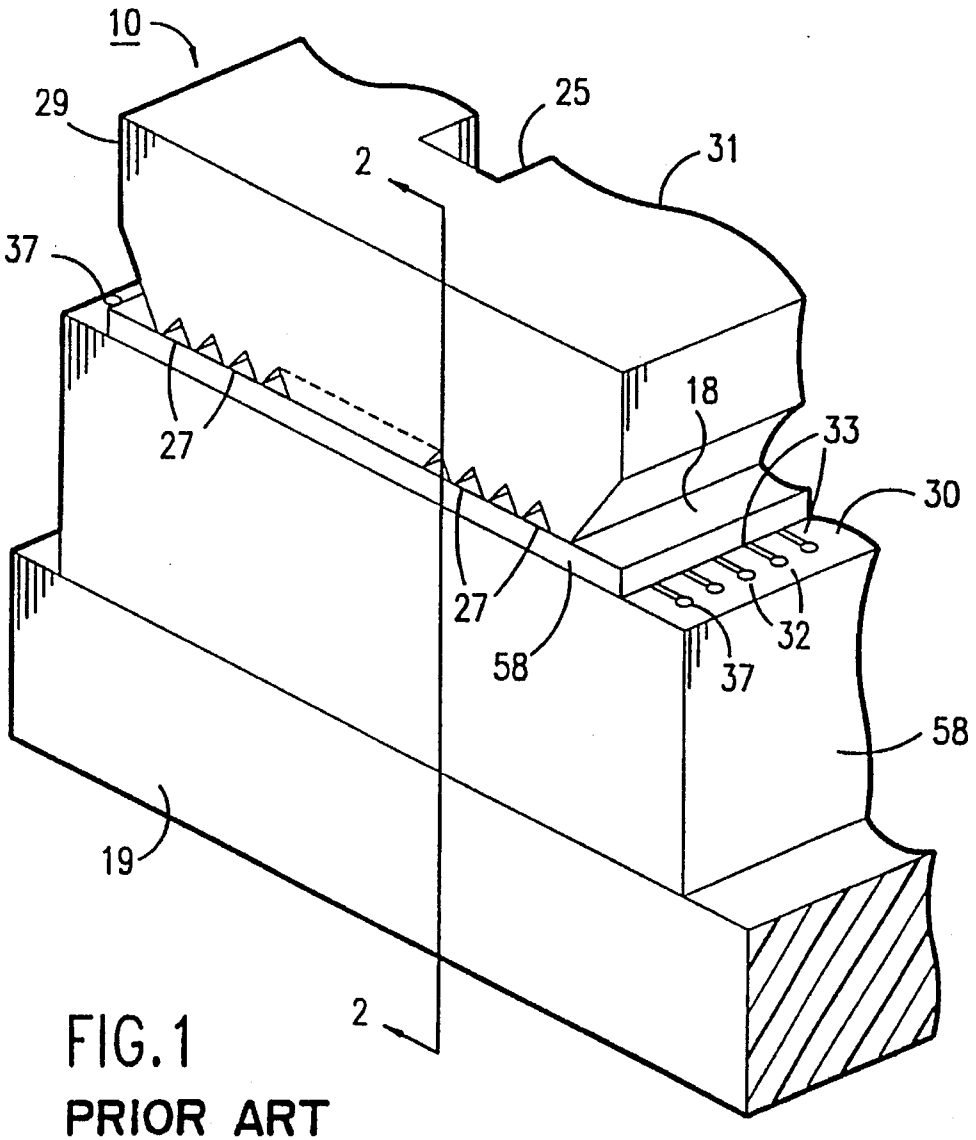
FIG. 1 PRIOR ART
FIG. 1 is an enlarged schematic isometric view of a printhead mounted on a daughter board showing the droplet emitting nozzles.
Figure 2:
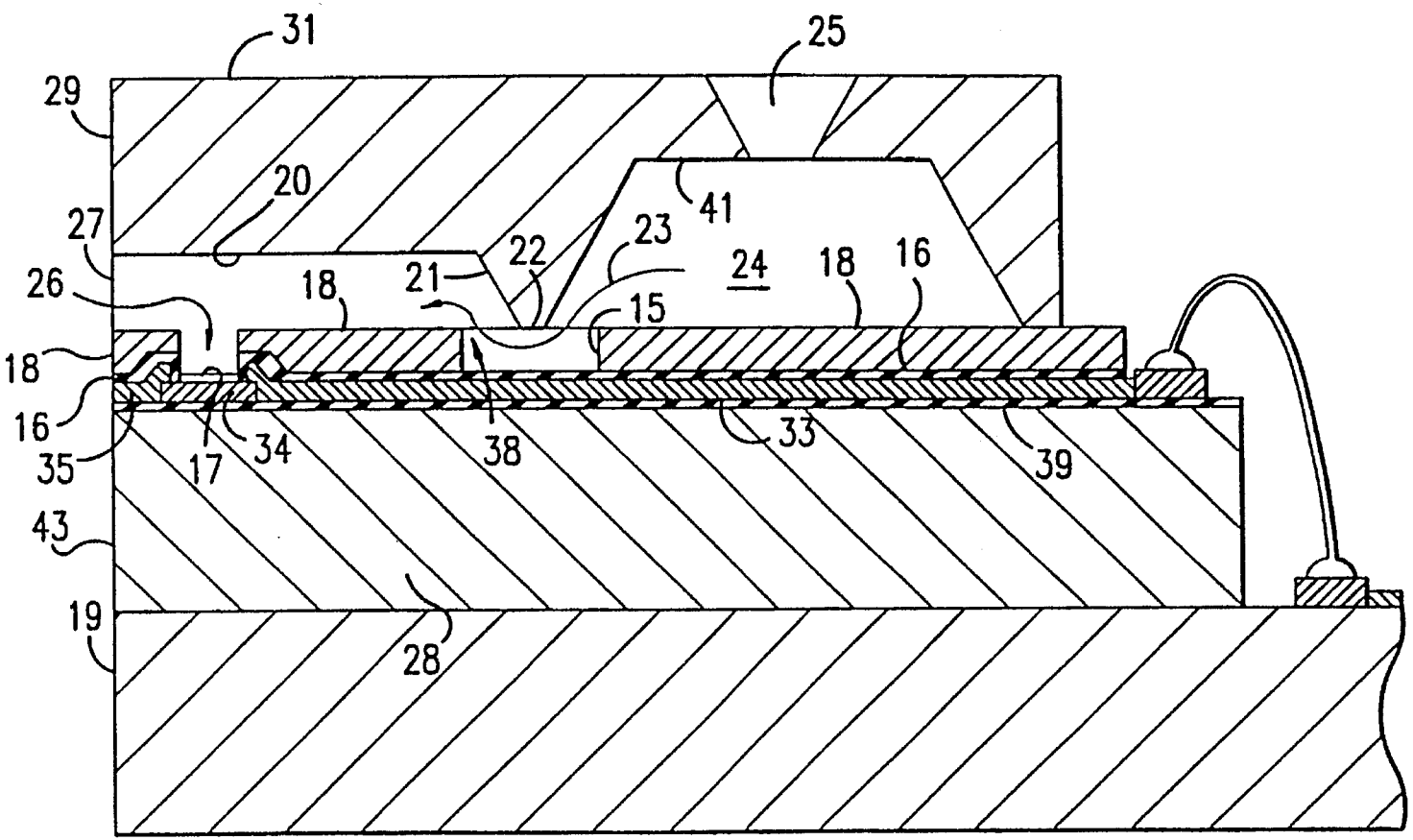
FIG. 2 PRIOR ART
FIG. 2 is an enlarged cross-sectional view of FIG. 1 as viewed along the line 2—2 thereof and showing the electrode passivation and ink flow path between the manifold and the ink channels.
Figure 3A:
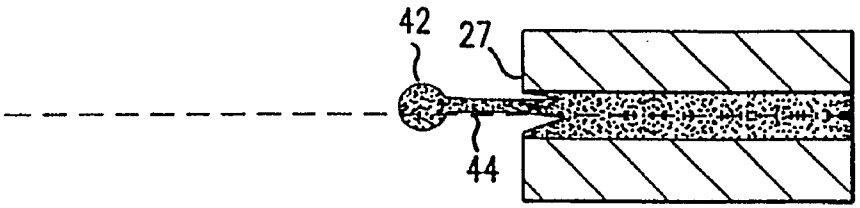
FIG.3(a) PRIOR ART
FIGS. 3*a*–3*d* are views showing how ink is ejected out of the nozzles of a printhead.
Figure 3B:
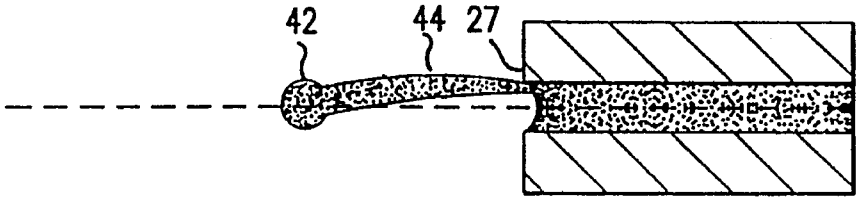
FIG.3(b) PRIOR ART
Figure 3C:
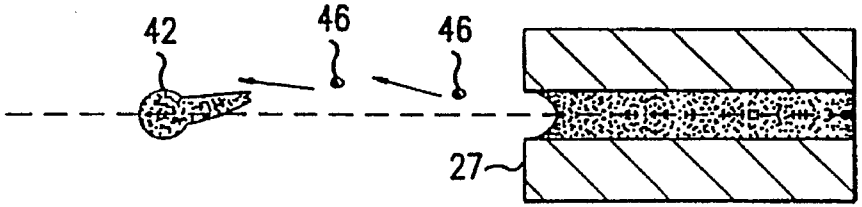
FIG.3(c) PRIOR ART
Figure 3D:
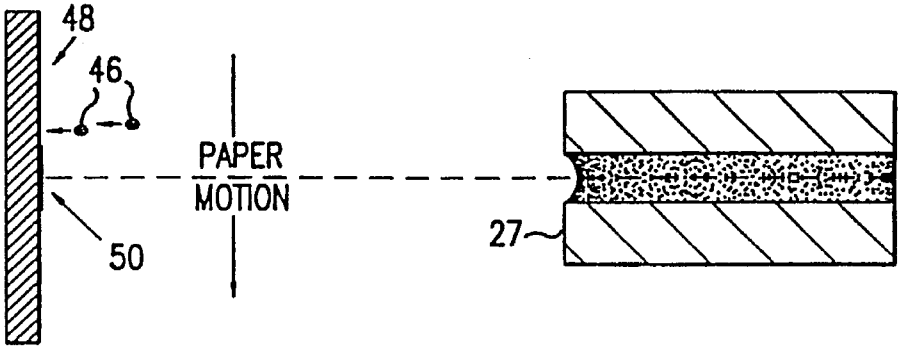

An enlarged, schematic isometric view of the front face 29 of the printhead 10 showing the array of droplet emitting nozzles 27 is depicted in FIG. 1. Referring also to FIG. 2, discussed later, the lower electrically insulating substrate or heater plate 28 has heating elements 34 and addressing electrodes 33 patterned on surface 30 thereof, while the upper substrate or channel plate 31 has parallel grooves 20 which extend in one direction and penetrate through the upper substrate front face edge 29. The other end of the grooves 20 terminate at slanted wall 21. The floor 41 of the internal recess 24 is used as the ink supply manifold for the capillary filled ink channels 20 and has an opening 25 therethrough for use as an ink fill hole. The surface of the channel plate 31 with the grooves 20 are aligned and bonded to the heater plate 28, so that a respective one of the plurality of heating elements 34 is positioned in each channel, formed by the grooves and the lower substrate or heater plate. Ink enters the manifold formed by the recess 24 and the lower substrate 28 through the fill hole 25 and by capillary action, fills the channels 20 by flowing through an elongated recess 38 formed in the thick film organic layer 18, which in a preferred embodiment is a polyimide layer. The thick film organic layer 18 will also be referred to as polyimide layer 18, but could alternatively be formed from a variety of thick film materials. The ink at each nozzle forms a meniscus, the surface tension of which prevents the ink from weeping therefrom. The addressing electrodes 33 on the lower substrate or channel plate 28 terminate at terminals 32. The upper substrate or channel plate 31 is smaller than that of the lower substrate in order that the electrode terminals 32 are exposed and available for wire bonding to the electrodes on the daughter board 19, on which the printhead 10 is permanently mounted. The thick film organic layer 18 is etched to expose the heating elements 34, thus placing them in a pit, and is further etched to form the elongated recess to enable ink flow between the manifold 24 and the ink channels 20. In addition, the thick film organic layer 18 is etched to expose the electrode terminals.

A cross sectional view of FIG. 1 is taken along view line 2—2 through one channel and shown as FIG. 2 to show how the ink flows from the manifold 24 and around the end 21 of the groove 20 as depicted by arrow 23. As is disclosed in U.S. Pat. No. 4,638,337 to Torpey et al., a plurality of sets of bubble generating heating elements 34 and their addressing electrodes 33 are patterned on the polished surface of a single side polished silicon wafer. Prior to patterning, the multiple sets of printhead electrodes 33, the resistive material that serves as the heating elements, and the common return 35, the polished surface of the wafer is coated with an underglaze layer 39 such as silicon dioxide, having a thickness of about 2 micrometers. The resistive material may be a doped polycrystalline silicon which may be deposited by chemical vapor deposition (CVD) or any other well known resistive material such as zirconium boride ($ZrB_2$). The common return and the addressing electrodes are typically aluminum leads deposited on the underglaze and over the edges of the heating elements. The common return ends or terminals 37 and addressing electrode terminals 32 are positioned at predetermined locations to allow clearance for wire bonding to the electrodes (not shown) of the daughter board 19, after the channel plate 31 is attached to make a printhead. The common return 35 and the addressing electrodes 33 are deposited to a thickness of 0.5 to 3 micrometers.

Next, a thick film type insulative layer 18 such as, for example, Riston®, Vacrel®, Probimer 52®, or polyimide, is formed on the passivation layer 16 having a thickness of between 10 and 100 micrometers and preferably in the range of 25 to 50 micrometers. The insulative layer 18 is a photolithographically processed to enable etching and removal of those portions of the layer 18 over each heating element (forming recesses 26), the elongated recess 38 for providing ink passage from the manifold 24 to the ink channels 20, and over each electrode terminal 32, 37. The elongated recess 38 is formed by the removal of this portion of the thick film layer 18. Thus, the passivation layer 16 alone protects the electrodes 33 from exposure to the ink in this elongated recess 38.

The passivated addressing electrodes are exposed to ink along the majority of their length and any pin hole in the normal electrode passivation layer 16 exposes the electrode 33 to electrolytes which would eventually lead to operational failure of the heating element addressed thereby. Accordingly, an added protection of the addressing electrode is obtained by the thick film layer 18, since the electrodes are passivated by two overlapping layers, passivation layer 16 and a thick film layer 18.

As disclosed in U.S. Pat. No. 4,601,777 and 4,638,337, the channel plate is formed from a two side polished, silicon wafer to produce a plurality of upper substrates 31 for the printhead. After the wafer is chemically cleaned, a pyrolytic CVD silicon nitride layer (not shown) is deposited on both sides. Using conventional photolithography, a via for fill hole 25 for each of the plurality of channel plates 31 and at least two vias for alignment openings (not shown) at predetermined locations are printed on one wafer side. The silicon nitride is plasma etched off of the patterned vias representing the fill holes and alignment openings. A potassium hydroxide (KOH) anisotropic etch may be used to etch the fill holes and alignment openings. In this case, the etch-resistant planes of the wafer make an angle of 54.7° with the surface of the wafer. The fill holes are small square surface patterns of about 20 mils (25 mm) per side and the alignment openings are about 60 to 80 mils (1.5 to 2 mm) square. Thus, the alignment openings are etched entirely through the 20 mil (0.5 mm) thick wafer, while the fill holes are etched to a terminating apex at about halfway through to three-quarters through the wafer. The relatively small square fill hole is invariant to further size increase with continued etching so that the etching of the alignment openings and fill holes are not significantly time constrained. Next, the opposite side of the wafer is photolithographically patterned, using the previously etched alignment holes as a reference to form the relatively large rectangular recesses 24 and sets of elongated, parallel channel recesses that will eventually become the ink manifolds and channels of the printheads. The surface 22 of the wafer containing the manifold and channel recesses are portions of the original wafer surface (covered by a silicon nitride layer) on which adhesive will be applied later for bonding it to the substrate containing the plurality of sets of heating electrodes.

A final front face dicing cut, which produces front face 29, opens one end of the elongated grooves 20 producing nozzles 27. The other ends of the channel grooves 20 remain closed by end 21. However, the alignment and bonding of the channel plate to the heater plate places the ends 21 of channels 20 directly over elongated recess 38 in the thick film insulative layer 18, as shown in FIG. 2, enabling the flow of ink into the channels. Then, a front-face hydrophobic coating 43 is applied to front face 29, at nozzles 27, to improve directionality of drops ejected from nozzles 27. The plasma cleaning process prior to front face coating can produce an etchback 52 in the polyimide layer, shown as distance $X_{PE}$ in FIGS. 5 and 6. The total amount of polyimide etchback is the result of the combined effects of material removal by the plasma etching process as well as material shrinkage caused by elevated temperature and vacuum exposure during the front face coating process. The amount of material removed by the plasma etching process can usually be controlled within reasonably close tolerances, but the amount of shrinkage in the polyimide layer 18 due to the front face coating process depends on polyimide processing details such as degrees of cure and amount of trapped solvents, and can be highly variable. The contribution to total polyimide etchback due to material shrinkage can sometimes be considerably larger than that due to plasma etch removal. This results in a polyimide scalloping effect at the front face where the deepest recesses of the edge of the polyimide layer 18 are at the center of the channels where the polyimide layer 18 is not pinned to the channel sides by adhesive. Accordingly, the polyimide etchback 52 is measured at the center of the channel.

Misdirected satellite drops in thermal ink jet printheads can cause observable print quality defects which significantly degrade the print quality performance of the printhead. This is especially true when the thermal ink jet printhead is used in bi-directional carriage printing applications, where satellite drops can fall within the main spot area when printing in one direction, but not in the other. When the misdirected satellite drops fall outside the main ink spot on the print medium, the resultant spot is no longer round, but rather elongated. The effectively larger and mis-shaped spot can result in optical density shifts in fine-toned print patterns as well as ragged edges in printed text and lines. Whether or not the satellite related print quality defects are observed depends on the direction of relative motion between the printhead and the print medium, the process speed, and the throw distance from nozzle to paper. The elongation of the spot always occurs along the process direction, and the physical origin of the misdirected satellite has been determined to be caused by "tail bending" of the ink drop ligament prior to break off from the nozzle face. FIGS. 3(*a*)–3(*d*) are views showing how ink droplets are ejected out of nozzles 27. FIG. 3(*a*) shows an ink droplet 42 ejected out of nozzle 27 without tail bending. In this case, satellite drops 46 generated by breakup of the tail will tend to follow the trajectory of the main drop and typically will not cause observable print quality defects. In FIG. 3(*b*), the ink droplet 42 has tail 44 which is bending. When the tail 44 breaks, as shown in FIG. 3(*c*), misdirected satellite drops 46 are created. As shown in FIG. 3(*d*), the misdirected satellite drops 46 may come into contact with print medium 48 so as to not be within main spot 50.

Figure 4:
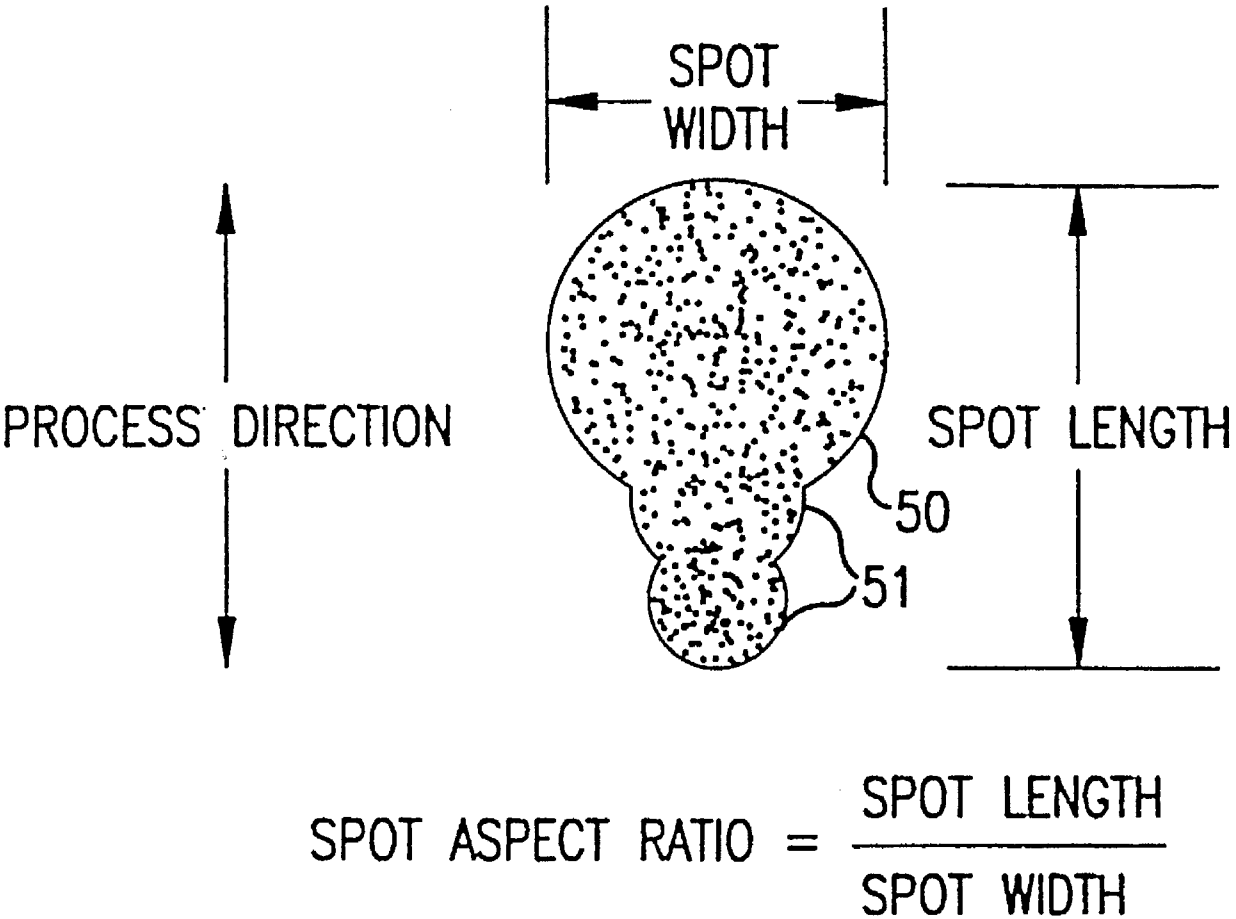
FIG. 4 is a view defining the Spot Aspect Ratio of an ink spot.

In order to characterize the magnitude of satellite related print quality defects as a function of changes in front face geometries, a Spot Aspect Ratio (SAR) is used. The Spot Aspect Ratio is shown in FIG. 4. The spot width is measured perpendicular to the process direction and is the width of main spot 50. The spot length is measured in the process direction and is the length of main spot 50 and any misdirected satellite spots 51. The Spot Aspect Ratio is the spot length divided by the spot width.

Figure 6:
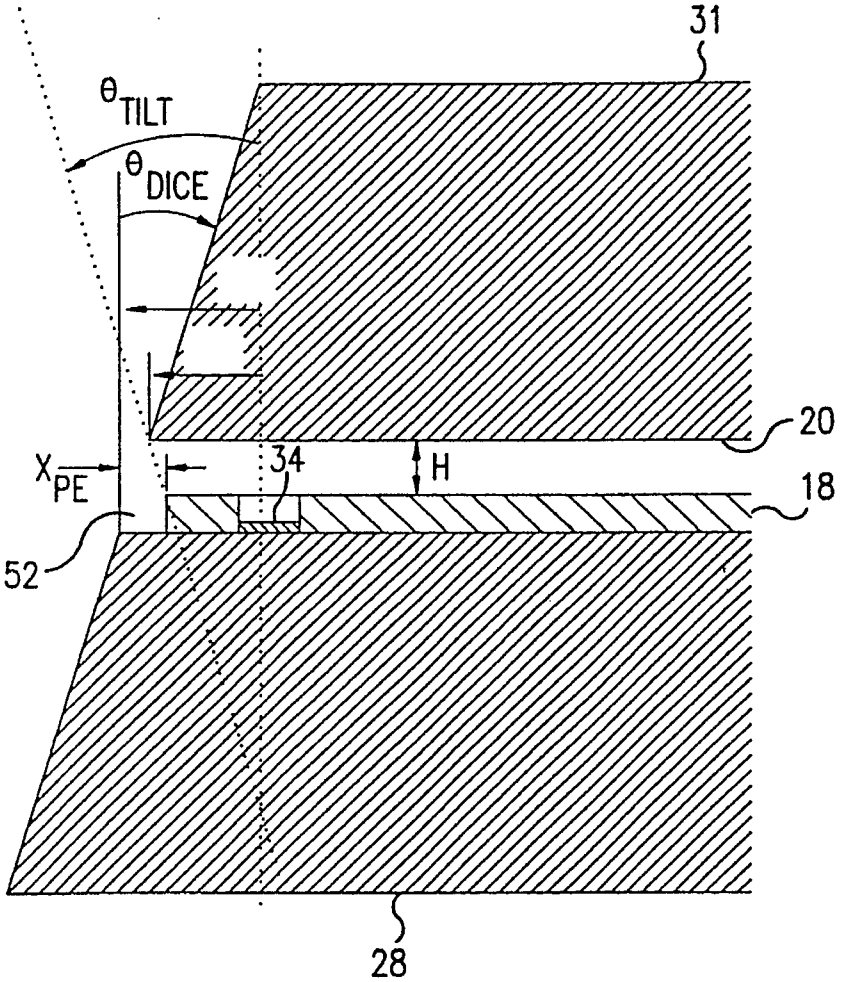
FIG. 6 is an enlarged view of the nozzle area showing a recessed apex front face geometry.
Figure 5:
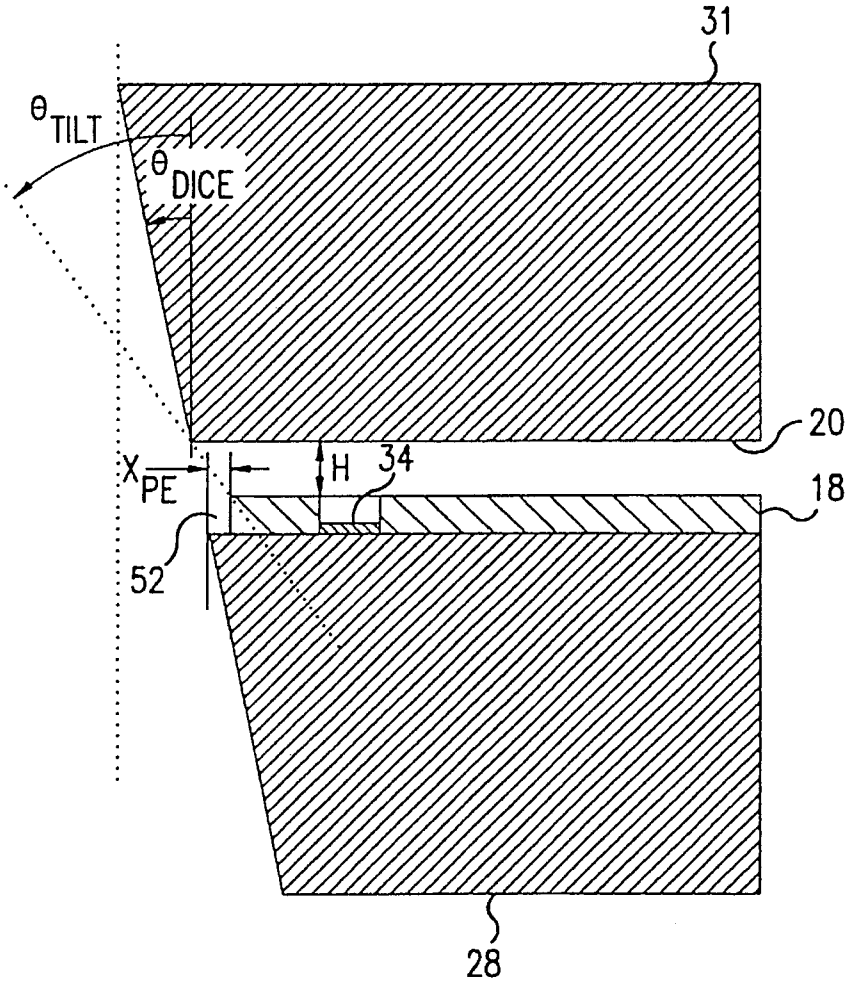
FIG. 5 is an enlarged view of the nozzle area showing a protruding apex front face geometry.
Figure 7:
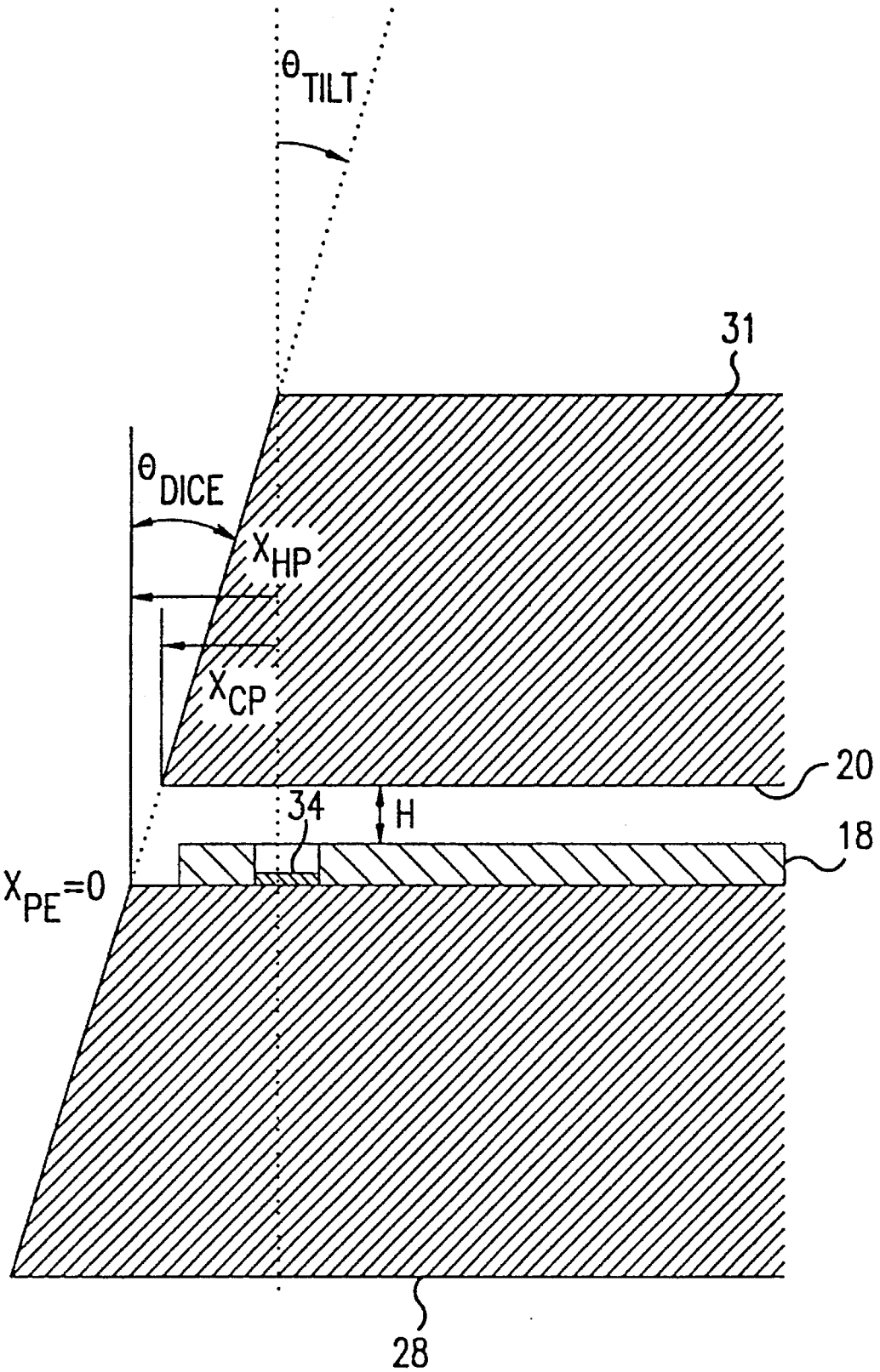
FIG. 7 is an enlarged view of the nozzle area showing a recessed apex front face geometry with no polyimide etchback.

For thermal ink jet devices, satellite-related print quality defects have been found to be observable and objectionable when SAR values of printed spots, exceeded levels of approximately 1.1. Detailed measurements of SAR were made as a function of changes in front face geometries. These measurements have shown that the magnitude and direction of the misdirected satellites correlate extremely well with the parameter referred to as the effective meniscus tilt angle ($\theta_{TILT}$) or EMTA, as shown in FIGS. 5–7. A simplified model of the meniscus, or free liquid surface of the column of ink in the channel, would have it pinned at the edges of the channel that terminates at the front face of the device, with front face surfaces having a hydrophobic coating that is effective in minimizing front face wetting. If the channel is symmetric at the front face, the plane of meniscus will be normal to the plane of the channel and no appreciable "tail bending" will occur. However, if the top or bottom of the channel protrudes even slightly at the front face, the ink meniscus will acquire an effective meniscus tilt angle with respect to the channel normal. Effective meniscus tilt angles can be introduced during device processing by non-perpendicular front face dicing angles and/or etchback of the polyimide layer 18, as shown in FIGS. 5 and 6. If the effective meniscus tilt angle exceeds certain limits in either the positive or negative direction, it has been determined that significant tail bending will occur, leading to misdirected satellite drops and SARs greater than the acceptable value of approximately 1.1.

FIG. 5 shows an enlarged view of the nozzle area showing a protruding apex front face geometry. As can be seen from FIG. 5, in a preferred embodiment, the effective meniscus tilt angle $\theta_{TILT}$ is influenced by three factors: 1) the front face dicing angle $\theta_{DICE}$, which is measured from a line perpendicular to the central axis of channel 20; 2) the polyimide etchback 52, shown as $X_{PE}$ in FIGS. 5–7; and 3) the distance H between an upper surface of the polyimide layer 18 and the lower surface of grooves formed in channel plate 31. Thus, the effective meniscus tilt angle $\theta_{TILT}$ in the preferred embodiment is measured as the angle from a line perpendicular to the center of channel 20 and a line drawn through the center of the upper front surface of polyimide layer 18 and the lower front edge of channel plate 31, as shown in FIGS. 5–7. However, the effective meniscus title angle could be measured in different ways. For example, if there was no etchback in polyimide layer 18, the effective meniscus tilt angle would be the same as the front face dicing angle, as shown in FIG. 7.

FIG. 6 shows an enlarged view of the nozzle area showing a recessed apex front face geometry. Both $\theta_{TILT}$ and $\theta_{DICE}$ are defined as positive when opening towards the left, as shown in FIG. 5 and negative when opening towards the right, such as $\theta_{DICE}$ shown in FIG. 6. The recessed apex front face geometry shown in FIG. 6 (resulting from a negative dicing angle) can still produce a positive effective meniscus tilt angle $\theta_{TILT}$.

FIG. 7 shows an enlarged view of the nozzle area showing a recessed apex front face geometry with no etchback in polyimide layer 18. Such a front face geometry has a dice angle $\theta_{DICE}$ and an effective meniscus tilt angle $\theta_{TILT}$ which are both negative. All of the front face geometries shown in FIGS. 5–7 produce a plane of the ink meniscus in the channel which deviates from perpendicular to the plane of the channel, causing either a positive or negative effective meniscus tilt angle $\theta_{TILT}$. All the front face geometries shown in FIGS. 5–7 could produce misdirected satellite drops, which could fall outside the main ink spot on the print medium, depending upon the magnitude of the effective meniscus tilt angle $\theta_{TILT}$.

Figure 8:
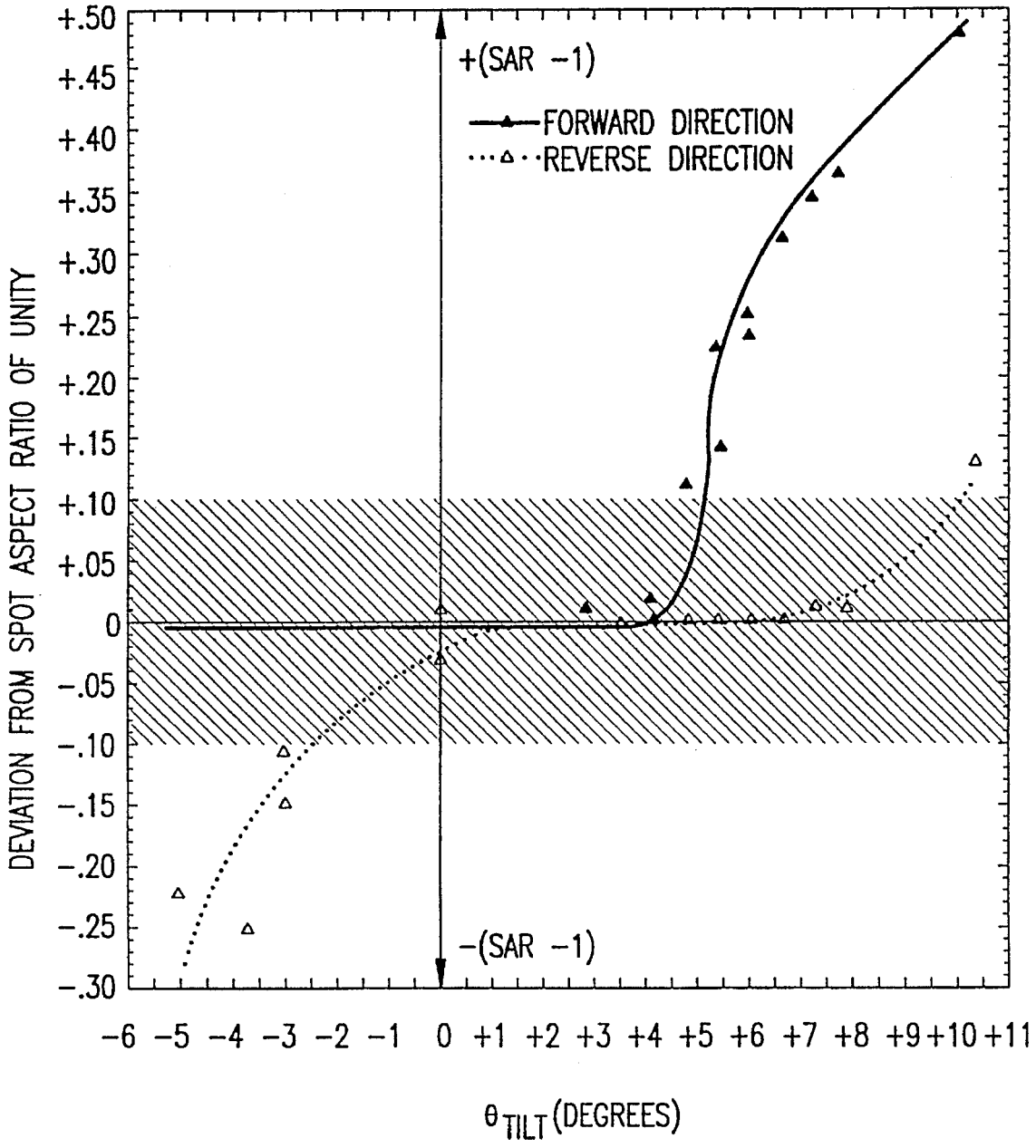
FIG. 8 is a diagram showing Spot Aspect Ratio in relation to effective meniscus tilt angle ($\theta_{TILT}$).

FIG. 8 is a diagram showing Spot Aspect Ratio (SAR) in relation to the effective meniscus tilt angle $\theta_{TILT}$. The data of FIG. 8, in order to be shown as a continually varying function, has the deviation from an aspect ratio of unity (i.e., a perfectly round spot) plotted along the ordinate axis. An assigned positive value for this function means that the satellite drops emerge from the main spot on the upper side of the channel as shown in the figures, while an assigned negative value means that the satellite drops emerge from the main spot on the lower side of the channel, regardless of print medium motion direction. The cross-hatched band on the plot of FIG. 8 shows the approximate range of SAR deviation which is regarded as being acceptable with respect to satellite-related defects. The data of FIG. 8 shows actual SAR values for a set of devices in which the front face geometries were intentionally varied to give $\theta_{TILT}$ values ranging from negative 5° to plus 10°. It is seen in this example that the effective meniscus tilt angle $\theta_{TILT}$ must be kept between values of approximately negative 2.5° and positive 4.5° or the SAR will exceed the value of 1.1 and the satellite-related print quality defects will be observable. From the data it is seen that a window which is free of observable satellite-related print quality defects exists for effective meniscus tilt angle values ranging from approximately negative 2° to plus 4°.

Figure 9:
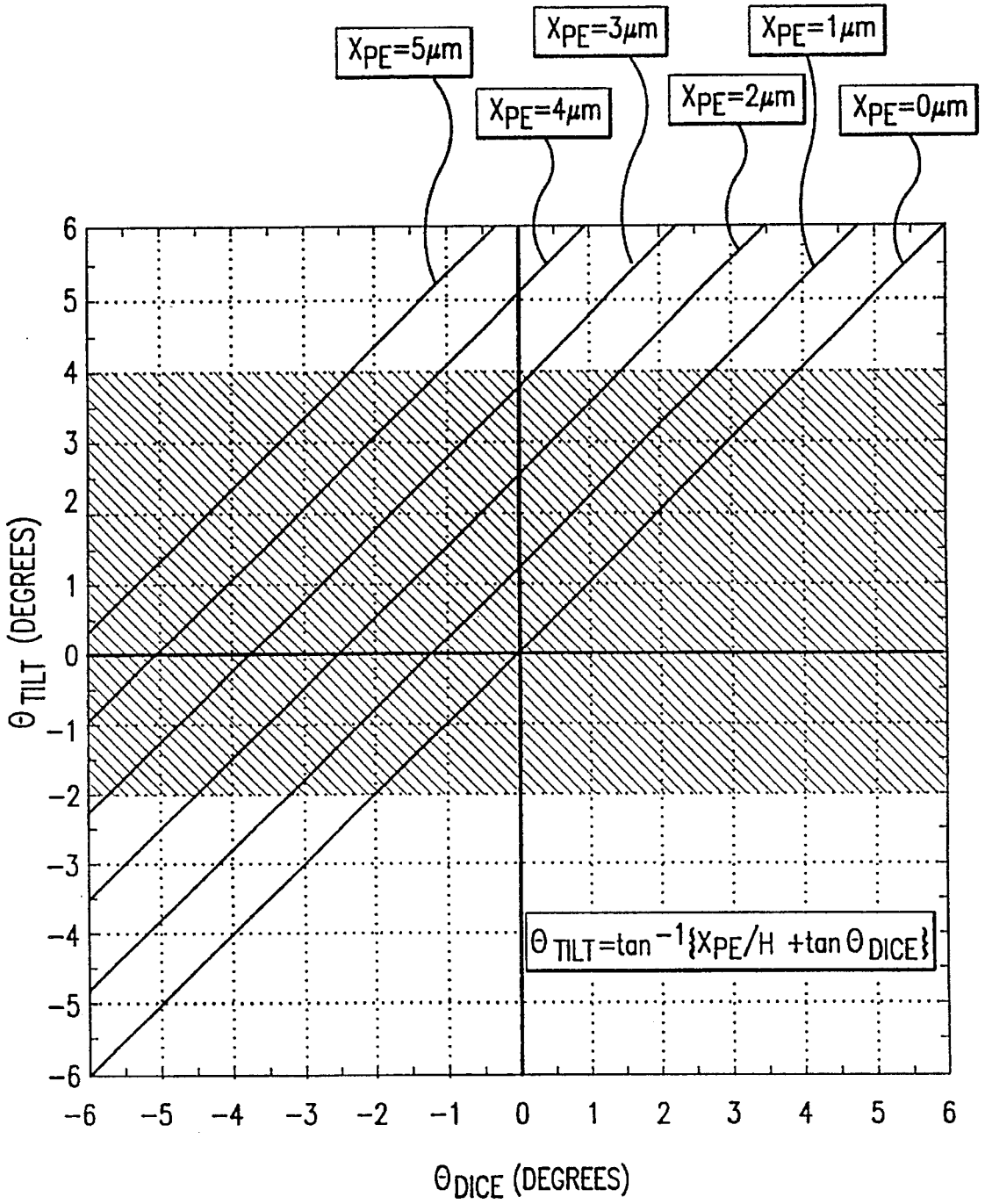
FIG. 9 is a diagram showing effective meniscus tilt angle in relation to Dicing Angle ($\theta_{TILT}$) and Polyimide Etchback ($X_{PE}$).

FIG. 9 is a diagram showing effective meniscus tilt angle $\theta_{TILT}$ in relation to dicing angle $\theta_{DICE}$ and polyimide etchback $X_{PE}$. The data has been expressed in terms of the device processing parameters through the use of simple trigonometric relationships. If the front face dicing angle $\theta_{DICE}$, polyimide etchback $X_{PE}$ and the distance H between the upper surface of polyimide layer 18 and an upper surface of grooves 20 are known, the effective meniscus tilt angle may be calculated from the following formula.

$$\theta_{TILT}=\tan^{-1}\{X_{PE}/H+\tan\theta_{DICE}\} \quad (1)$$

In FIG. 9, the allowed range of effective meniscus tilt angle $\theta_{TILT}$ values (cross hatched region) is plotted against these critical manufacturing process parameters so that appropriate tolerance tradeoffs for defect-free devices can be determined. The data plotted in this figure have been calculated with the channel height distance H being equal to 45 μm. Various values of the polyimide etchback are shown in FIG. 9.

As detailed above, the present invention allows precise determination of acceptable process latitude windows for the dicing angle $\theta_{DICE}$ and the polyimide etchback distance $X_{PE}$ and variation of these parameters so that no print quality defects will occur due to misdirected satellite drops caused by too large of an effective meniscus tilt angle.

While this invention has been described in conjunction with the specific embodiment thereof, it is evident that many alternatives, modifications and variations will be apparent to those skilled in the art. For example, the thick film organic layer 18 may be a material other than polyimide, such as Vacrel®, Riston®, or Probimer®. Accordingly, the preferred embodiments of this invention, as set forth herein, are intended to be illustrative, not limiting. Various changes may be made without departing from the spirit and scope of the invention as defined in the following claims.

What is claimed is:

1. An ink jet printhead for ejecting ink droplets from a plurality of nozzles in a front face of the printhead, the ink droplets being ejected onto a print medium moving in a process direction, the ink droplets forming ink spots on said print medium, said printhead comprising:

a channel plate having a surface transverse to the front face etched with a plurality of grooves for use as ink channels, the ink channels each having an open end at the front face of said printhead and a closed end;

a heater plate bonded at the channel plate, the heater plate having a plurality of heater elements on a surface of the heater plate that is transverse to the front face, each of the heater elements located within one of the plurality of grooves of the channel plate;

a passivating layer applied on the surface of the heater plate and on the heater elements; and a thick film insulative layer deposited on the passivating layer, said thick film insulative layer etched to remove the thick film insulative layer over the heater elements and including an etchback in the thick film insulative layer from the front face of the printhead;

wherein said front face includes a front face dicing angle measured between a line perpendicular to the ink channels and the front face, the front face dicing angle and a distance of the etchback of the thick film insulative layer being controlled to maintain a Spot Aspect Ratio of each of said ink spots on said medium in a predetermined range, the Spot Aspect Ratio being equal to a length of any of said ink spots measured in the process direction divided by the corresponding width of any of said ink spots measured perpendicular to the process direction.

2. The ink jet printhead according to claim 1, wherein the predetermined range for the Spot Aspect Ratio is between approximately 1.0 and 1.1 for each of said ink spots.

3. The ink jet printhead according to claim 1, wherein said thick film insulative layer comprises a polyimide layer.

4. The ink jet printhead according to claim 1, further comprising a hydrophobic front face coating applied to the front face of said printhead at the open ends of said grooves.

5. The ink jet printhead according to claim wherein application of the hydrophobic front face coating removes the thick film insulative layer for a distance from the front face to create the etchback.

6. The ink jet printhead according to claim 5, wherein the predetermined range of the Spot Aspect Ratio is between approximately 1.0 and at 1.1 for each of said ink spots.

7. The ink jet printhead according to claim 5, wherein the Spot Aspect Ratio is maintained by the control of an effective meniscus title angle defined according to the following formula:

$$\theta_{TILT}=\tan^{-1}\{X_{PE}/H+\tan\theta_{DICE}\}$$

wherein $\theta_{TILT}$ is the effective meniscus tilt angle measured between a line perpendicular to the ink channels and a line through an upper front surface of said thick film insulative layer and a lower front edge of said channel plate, $\theta_{DICE}$ is the front face dicing angle measured from the line perpendicular to the ink channels, $X_{PE}$ is the distance of the thick film insulative layer etchback and H is a distance between the thick film insulative layer and the grooves formed in said channel plate.

8. The ink jet printhead according to claim 7, wherein the effective meniscus tilt angle is between −2.0° and 4.0°.

9. An ink jet printhead for ejecting ink droplets from a plurality of nozzles in a front face of the printhead, the ink droplets being ejected onto a print medium moving in a process direction, the ink droplets forming ink spots on said print medium, said printhead comprising:

a channel plate having a surface transverse to the front face etched with a plurality of grooves for use as ink channels, the ink channels each having an open end at the front face of said printhead and a closed end;

a heater plate bonded to the channel plate, the heater plate having a plurality of heater elements on a surface of the heater plate that is transverse to the front face, each of the heater elements located within one of the plurality of grooves of the channel plate;

a passivating layer applied on the surface of the heater plate and on the heater elements;

a thick film insulative layer deposited on the passivating layer, said thick film insulative layer etched to remove the thick film insulative layer over the heater elements;

a hydrophobic front face coating applied to the front face of said printhead by a hydrophobic front face coating process at the open ends of said grooves; and an etchback in the thick film insulative layer from the front face of said printhead application of the hydrophobic front face coating process removing the thick film insulative layer for a distance from the front face to create the etchback;

wherein said etchback is controlled to maintain a Spot Aspect Ratio of each of said ink spots on said medium in a predetermined range, the Spot Aspect Ratio being equal to a length of any of said ink spots measured in the process direction divided by a corresponding width of any of said ink spots measured perpendicular to the process direction.

10. The ink jet printhead according to claim 9, wherein the predetermined range for the Spot Aspect Ratio is between approximately 1.0 and 1.1 for each of said ink spots.

11. The ink jet printhead according to claim 9, wherein said thick film insulative layer comprises a polyimide layer.

12. The ink jet printhead according to claim 9, wherein the Spot Aspect Ratio is maintained within the predetermined range by the control of an effective meniscus title angle defined according to the following formula:

$$\theta_{TILT}=\tan^{-1}\{X_{PE}/H\}$$

wherein $\theta_{TILT}$ is the effective meniscus tilt angle measured between a line perpendicular to the ink channels and a line through an upper front surface of said thick film insularly layer and a lower front edge of said channel plate, $X_{PE}$ is the distance of the thick film insulative layer etchback and H is a distance between the thick film insulative layer and the grooves formed in said channel plate.

13. The ink jet printhead according to claim 12, wherein the effective meniscus tilt angle is between −2.0° and 4.0°.

14. A method of forming an ink jet printhead, said ink jet printhead for ejecting ink droplets onto a print medium moving in a process direction, the ink droplets forming ink spots on said print medium, the method comprising the steps of:

forming an upper channel plate having on a surface a plurality of etched ink channels, the ink channels each having an open end at a front face of said printhead and a closed end;

forming a lower heater plate having on a surface an array of heater elements;

applying a passivating layer on the surface of the lower heater plate;

applying a thick film insulative layer on the passivating layer;

etching the thick film insulative layer over the heater elements;

forming an etchback in the thick film insulative layer from the front face of the printhead;

bonding the upper channel plate to the lower heater plate to form the printhead, each of the plurality of heater elements located within one of the plurality of ink channels;

dicing the front face of the printhead at a front face dicing angle, the front face dicing angle and a distance of the etchback being controlled to maintain a Spot Aspect Ratio of each of said ink spots on said medium in a predetermined range, the front face dicing angle measured between a line perpendicular to the ink channels at the front face, the Spot Aspect Ratio being equal to a length of any of said ink spots measured in the process direction divided by a corresponding width of any of said ink spots measured perpendicular to the process direction.

15. The method of claim 14, wherein the predetermined range for the Spot Aspect Ratio is between approximately 1.0 and 1.1 for each of said ink spots.

16. The method of claim 14, wherein said thick film insulative layer comprises a polyimide layer.

17. The method of claim 14, further comprising the step of applying a hydrophobic front face coating to the front face of said printhead at the open ends of said grooves.

18. The method of claim 14, wherein the predetermined range for the Spot Aspect Ratio is between approximately 1.0 and 1.1 for each of said ink spots.

19. The method according to claim 15, wherein the Spot Aspect Ratio is maintained in the predetermined range by the control of an effective meniscus title angle defined according to the following formula:

$$\theta_{TILT}=\tan^{-1}\{X_{PE}/H+\tan\theta_{DICE}\}$$

wherein $\theta_{TILT}$ is the effective meniscus tilt angle measured between a line perpendicular to the ink channels and a line through an upper front surface of said thick film insulative layer and a lower front edge of said channel plate, $\theta_{DICE}$ is the front face dicing angle measured from a line perpendicular to the ink channels, $X_{PE}$ is the distance of the thick film insulative layer etchback and H is a distance between the thick film insulative layer and the grooves formed in said channel plate.

20. The method according to claim 19, wherein the effective meniscus tilt angle is maintained between −2.0° and 4.0°.

21. A method of forming an ink jet printhead, said ink jet printhead for ejecting ink droplets onto a print medium moving in a process direction, the ink droplets forming ink spots on said print medium, the method, comprising the steps of:

forming an upper channel plate having on one surface a plurality of etched ink channels, the ink channels each having an open end at a front face of said printhead and a closed end;

forming a lower heater plate having on a surface an array of heater elements;

applying a passivating layer on the surface of the lower heater plate;

applying a thick film insulative layer on the passivating layer;

etching the thick film insulative layer over the heater elements;

bonding the upper channel plate to the lower heater plate to form the printhead, each of the plurality of heater elements located within one of the plurality of ink channels;

applying a hydrophobic front face coating to the front face of said printhead at the open ends of said grooves; and forming an etchback in the thick film insulative layer from the front face of said printhead;

controlling a distance the thick film insulative layer is etched back to maintain a Spot Aspect Ratio of each of said ink spots on said medium in a predetermined range, the Spot Aspect Ratio being equal to a length of any of said ink spots measured in the process direction divided by a corresponding width of any of said ink spots measured perpendicular to the process direction.

22. The method according to claim 21, wherein the predetermined range for the Spot Aspect Ratio is between approximately 1.0 and 1.1 for each of said ink spots.

23. The method according to claim 21, wherein said thick film insulative layer comprises a polyimide layer.

24. The method according to claim 21, wherein the Spot Aspect Ratio is maintained in the predetermined range by controlling an effective meniscus title angle defined according to the following formula:

$$\theta_{TILT}=\tan^{-1}\{X_{PE}/H\}$$

wherein $\theta_{TILT}$ is the effective meniscus tilt angle measured between a line perpendicular to the ink channels and a line through an upper front surface of said thick film insulative layer and a lower front edge of said channel plate, $X_{PE}$ is the distance of the thick film insulative layer etchback and H is a distance between the thick film insulative layer and the grooves formed in said channel plate.

25. The method according to claim 24, wherein the effective meniscus tilt angle is between −2.0° and 4.0°.

* * * * *